US007281775B2

(12) United States Patent
Yang

(10) Patent No.: US 7,281,775 B2
(45) Date of Patent: Oct. 16, 2007

(54) SUPPORTER FOR CLOTHES WASHING MACHINE AND CLOTHES DRYING APPARATUS

(75) Inventor: Yoon Seok Yang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 155 days.

(21) Appl. No.: 11/092,601

(22) Filed: Mar. 29, 2005

(65) Prior Publication Data

US 2005/0275325 A1 Dec. 15, 2005

(30) Foreign Application Priority Data

Jun. 14, 2004 (KR) ..... 10-2004-0043779
Jun. 15, 2004 (KR) ..... 10-2004-0044038

(51) Int. Cl.
*A47B 88/00* (2006.01)

(52) U.S. Cl. ..... 312/348.1; 312/334.7

(58) Field of Classification Search ..... 312/107, 312/108, 111, 330.1, 351, 348.1, 348.2, 348.4, 312/350, 334.1, 334.7, 334.8, 334.13; 384/22
See application file for complete search history.

(56) References Cited

U.S. PATENT DOCUMENTS 1,756,984 A * 5/1930 Mason ..... 312/107
2,780,510 A * 2/1957 Cole, Jr. ..... 312/334.13
4,579,402 A 4/1986 Wenzlick et al.
4,925,258 A * 5/1990 Ludwig et al. ..... 312/323
5,211,461 A * 5/1993 Teufel et al. ..... 312/334.4
5,215,362 A * 6/1993 Zoellner ..... 312/246
5,409,309 A 4/1995 Giddings et al.
5,520,452 A * 5/1996 Petersen et al. ..... 312/334.12

(Continued)

FOREIGN PATENT DOCUMENTS

DE 26 11 94 * 3/1995

(Continued)

OTHER PUBLICATIONS

European Search Report for corresponding European Application No. EP 05 25 1663 dated Apr. 6, 2006.

*Primary Examiner*—Janet M. Wilkens
(74) *Attorney, Agent, or Firm*—Staas & Halsey LLP

(57) ABSTRACT

A supporter for a clothes washing machine and a clothes drying apparatus for smoothly sliding a drawer in and out of a case regardless of temperature change by improving the structure of the drawer to be installed in the case. The supporter includes a case to support a clothes washing machine or a clothes drying apparatus and a drawer to be inserted into the case. The drawer includes a main body having an accommodating space, slide rails to be coupled with lateral sides of the main body, a connecting member to connect and support the slide rails, and a front panel to be coupled with a front side of the main body. The slide rails and the connecting member include first screw holes, and the main body further includes bosses at the lateral sides and the rear side of the main body. The bosses include second screw holes corresponding to the first screw holes. The connecting member and the main body include a position determining hole and a position determining protrusion at respective rear central portions. Fixed rails for sliding the slide rails are fixed to the inside of the lateral sides of the case.

8 Claims, 6 Drawing Sheets

U.S. PATENT DOCUMENTS

| | | | | |
|---|---|---|---|---|
| 5,618,091 | A | 4/1997 | Huber et al. | |
| 5,785,402 | A * | 7/1998 | DeLorenzo | 312/350 |
| 6,416,145 | B1 | 7/2002 | Singh | |
| 2003/0030353 | A1 | 2/2003 | Remmers | |
| 2003/0111943 | A1 * | 6/2003 | Banicevic et al. | 312/404 |
| 2004/0108797 | A1 | 6/2004 | Chen et al. | |
| 2004/0207302 | A1 * | 10/2004 | Kao | 312/348.1 |
| 2004/0263032 | A1 * | 12/2004 | Cho | 312/330.1 |
| 2005/0063883 | A1 * | 3/2005 | Sullivan | 422/292 |

FOREIGN PATENT DOCUMENTS

| | | | |
|---|---|---|---|
| DE | 203 02 572 | U1 | 4/2003 |
| EP | 1 205 129 | A1 | 5/2002 |
| JP | 08-083380 | | 3/1996 |
| JP | 09-173169 | | 7/1997 |
| KR | 20020076664 | * | 10/2002 |
| KR | 2002-0085435 | | 11/2002 |

* cited by examiner

SUPPORTER FOR CLOTHES WASHING MACHINE AND CLOTHES DRYING APPARATUS

CROSS-REFERENCE TO RELATED APPLICATIONS

This application claims the benefit of Korean Patent Application Nos. 2004-043779 and 2004-044038, filed on Jun. 14, 2004 and Jun. 15, 2004, respectively, in the Korean Intellectual Property Office, the disclosure of which is incorporated herein by reference.

BACKGROUND OF THE INVENTION

1. Field of the Invention

The present invention relates to a supporter for a clothes washing machine and a clothes drying apparatus, and more particularly to a supporter for a clothes washing machine and a clothes drying apparatus in which a drawer positioned in the supporter, smoothly slides against a case regardless of temperature change by improving the structure of the drawer to be attached and detached to the case.

2. Description of the Related Art

Generally, in order to wash and dry laundry, a clothes washing machine and a clothes drying apparatus are utilized. The clothes washing machine and the clothes drying apparatus are divided into a drum type clothes washing machine and a drum type clothes drying apparatus for washing and drying laundry by rotating a rotating tub about a horizontal axis. A vertical axis type clothes washing machine and a vertical axis type clothes drying apparatus for washing and drying laundry by rotating the rotating tub about a vertical axis.

Among the drum type clothes washing machines and the vertical axis type clothes washing machines, there is a clothes washing machine having a device for drying laundry so as to perform drying as well as washing.

Since the clothes washing machine and the clothes drying apparatus usually wash and dry laundry by using the rotation of the rotating tub, maintaining a dynamic balance of the rotating tub during rotation is essential. Thus, when the clothes washing machine or drying apparatus are positioned on a non-flat surface, it is necessary to level the surface in order to position the clothes washing machine or the clothes drying apparatus at a level. However, since the clothes washing machine and the clothes drying apparatus are large and heavy, it is very difficult to level the clothes washing machine or the clothes drying apparatus.

Thus, when placing the clothes washing machine or the clothes drying apparatus on a light and small supporter after leveling the supporter on the ground, it is very convenient to install the clothes washing machine or the clothes drying apparatus.

The supporter supports the clothes washing machine or the clothes drying apparatus, and accommodates small-sized clothes and goods to be used when washing clothes. The supporter includes a box-shaped case with an open front and a drawer to be slid from the open front of the case.

However, since the above-mentioned conventional supporter is usually made of synthetic resin for the purpose of reducing the manufacturing cost and weight, and convenient manipulation thereof, the drawer and the case can be deformed by the temperature change at the installation location. For this reason, the drawer may not be smoothly slid from the case, and further the drawer may not be slid at all under certain circumstances.

Particularly, in the case when the clothes washing machine or the clothes drying apparatus is installed outdoors, such as on a veranda or balcony, the supporter is exposed to high temperatures in the summer and low temperatures in the winter. Thus, the difference between coefficients of the linear expansion of the drawer and rails installed at both sides of the drawer for the sliding movement of the drawer prevent the drawer from smoothly sliding through the case.

SUMMARY OF THE INVENTION

Accordingly, it is an aspect of the present invention to provide a supporter for a clothes washing machine and a clothes drying apparatus for smoothly sliding a drawer into and from a case regardless of temperature change by improving the structure of the drawer to be installed in the case.

Additional aspects and/or advantages of the invention will be set forth in part in the description which follows and, in part, will be obvious from the description, or may be learned by practice of the invention.

The foregoing and/or other aspects of the present invention are achieved by providing a supporter for a clothes washing machine and a clothes drying apparatus including a case to support the clothes washing machine or the clothes drying apparatus, and a drawer inserted into the case. The drawer includes a main body having an accommodating space, a pair of slide rails coupled with lateral sides of the main body, and a connecting member to connect the slide rails with each other and to support the slide rails. The main body further includes a position determining protrusion at a rear side of the main body, and the connecting member which is coupled with the slide rails includes a position determining hole in which the position determining protrusion is inserted therein.

The position determining protrusion and the position determining hole are positioned at a rear central portion of the main body and a central portion of the connecting member, respectively.

The drawer further includes a front panel coupled with a front side of the main body, and the front panel includes a grip to move the drawer.

The main body and the front panel are made of a non-metal material, and the slide rails and the connecting member are made of a metal material.

Moreover, the main body and the front panel are made of synthetic resin, and the slide rails and the connecting member are made of steel.

The slide rails and the connecting member each include first screw holes, respectively, and the main body further includes at least one boss having second screw holes at lateral sides of the main body.

Each first screw hole of the slide rails and the connecting member is formed in the longitudinal direction, thereby enabling the first screw holes to be firmly coupled with the respective second screw holes even when the lateral sides and the rear side of the main body are deformed and changed in size.

A plurality of ribs are provided around the bosses so as to prevent the bosses from deformation.

It is another aspect of the present invention to provide a supporter for a clothes washing machine and a clothes drying apparatus including a case for supporting the clothes washing machine or the clothes drying apparatus, and a drawer inserted into the case, wherein the drawer includes a main body having an accommodating space, a pair of slide rails coupled with lateral sides of the main body, and a connecting member to connect the slide rails with each other and to support the slide rails, wherein the slide rails and the connecting member each include at least one first screw hole, respectively, and the main body includes at least one boss having second screw holes at the lateral sides of the main body.

Each first screw hole of the slide rails and the connecting member are of a longitudinal shape having a length greater than the diameter of the second screw holes, thereby enabling the first screw holes to be firmly coupled with the respective second screw holes even when the lateral sides and the rear side of the main body are deformed thus changing their sizes.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
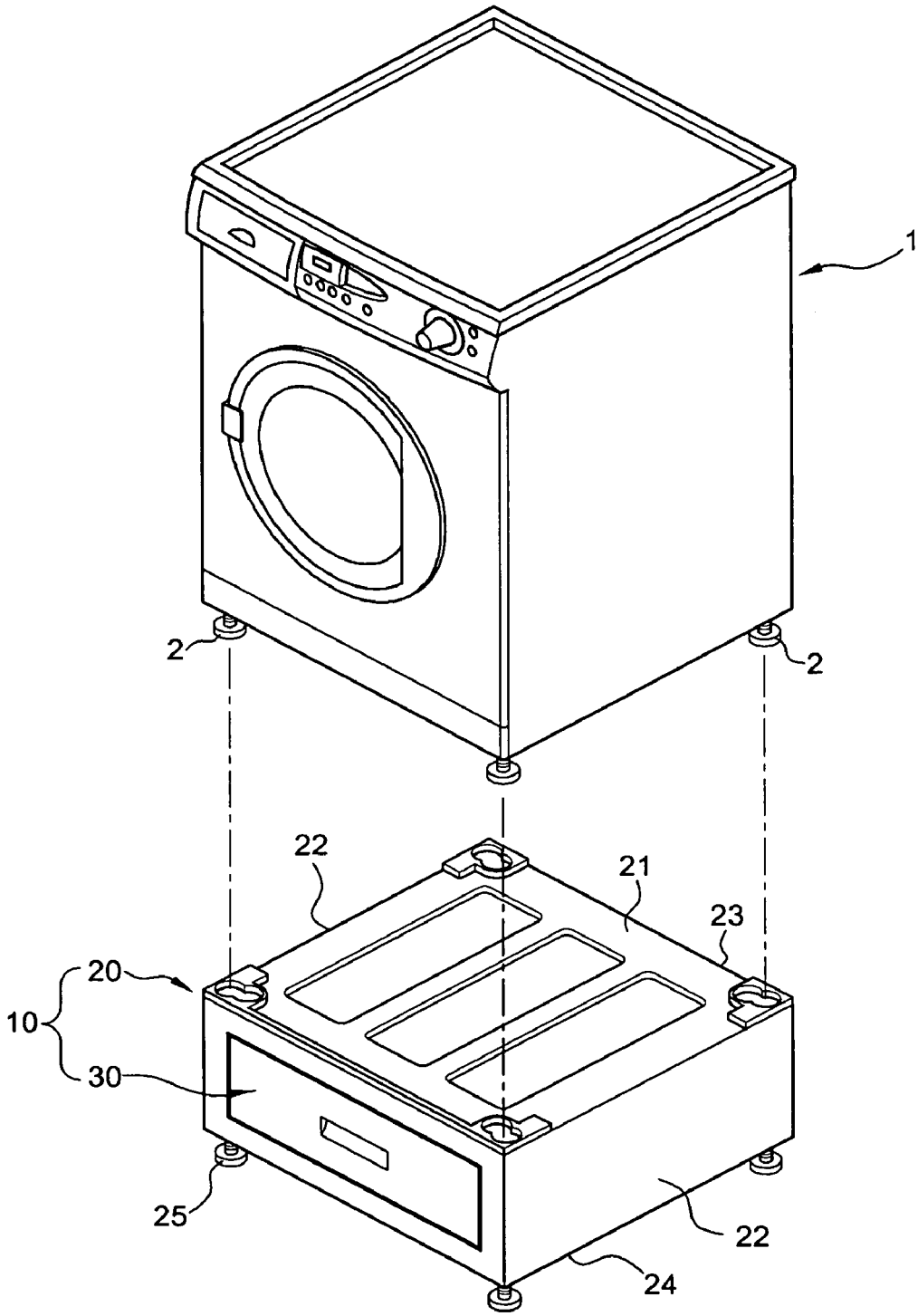
FIG. 1 is a perspective view illustrating a state of separating a supporter according to the present invention and a clothes washing machine or a clothes drying apparatus positioned on the supporter.

Reference will now be made in detail to the embodiments of the present invention, examples of which are illustrated in the accompanying drawings, wherein like reference numerals refer to the like elements throughout. The embodiments are described below to explain the present invention by referring to the figures.

The supporter according to the present invention can be applied to both the drum type and the vertical axis type clothes washing machines and the drum type and the vertical axis type drying apparatuses.

FIG. 1 is a perspective view illustrating a state of separating a supporter according to the present invention and a clothes washing machine or a clothes drying apparatus which is placed on the supporter.

In FIG. 1, a supporter 10 according to the an embodiment of the present invention includes a case 20 on which the clothes washing machine (or clothes drying machine; hereinafter referred to as a "clothes washing machine") is placed and a drawer 30 inserted into the case 20.

The case 20 includes an upper side 21, lateral sides 22, a rear side 23, and a bottom side 24 to approximately form a front-side-open box shape. Height-adjustable legs 25 are installed at each corner of the bottom side 24 of the case, and thus it is possible to level the upper side 21 of the case 20 where the supporter 10 is positioned.

The clothes washing machine 1 is positioned on the upper side 21 of the case 20 and is supported by the supporter 10. Legs 2 are installed to each lower side corner of the clothes washing machine 1 and are located on each corner of the upper side 21 of the case 20, thereby enabling the clothes washing machine 1 to be placed on the supporter 10 while maintaining a gap corresponding to the height of the legs 2 between the clothes washing machine 1 and the supporter 10.

Thus, when the supporter 10 is positioned in a state of leveling the upper side 21 of the case 20 in advance of installing the clothes washing machine 1, the clothes washing machine 1 may be conveniently and rapidly installed at a leveled state.

Figure 2:
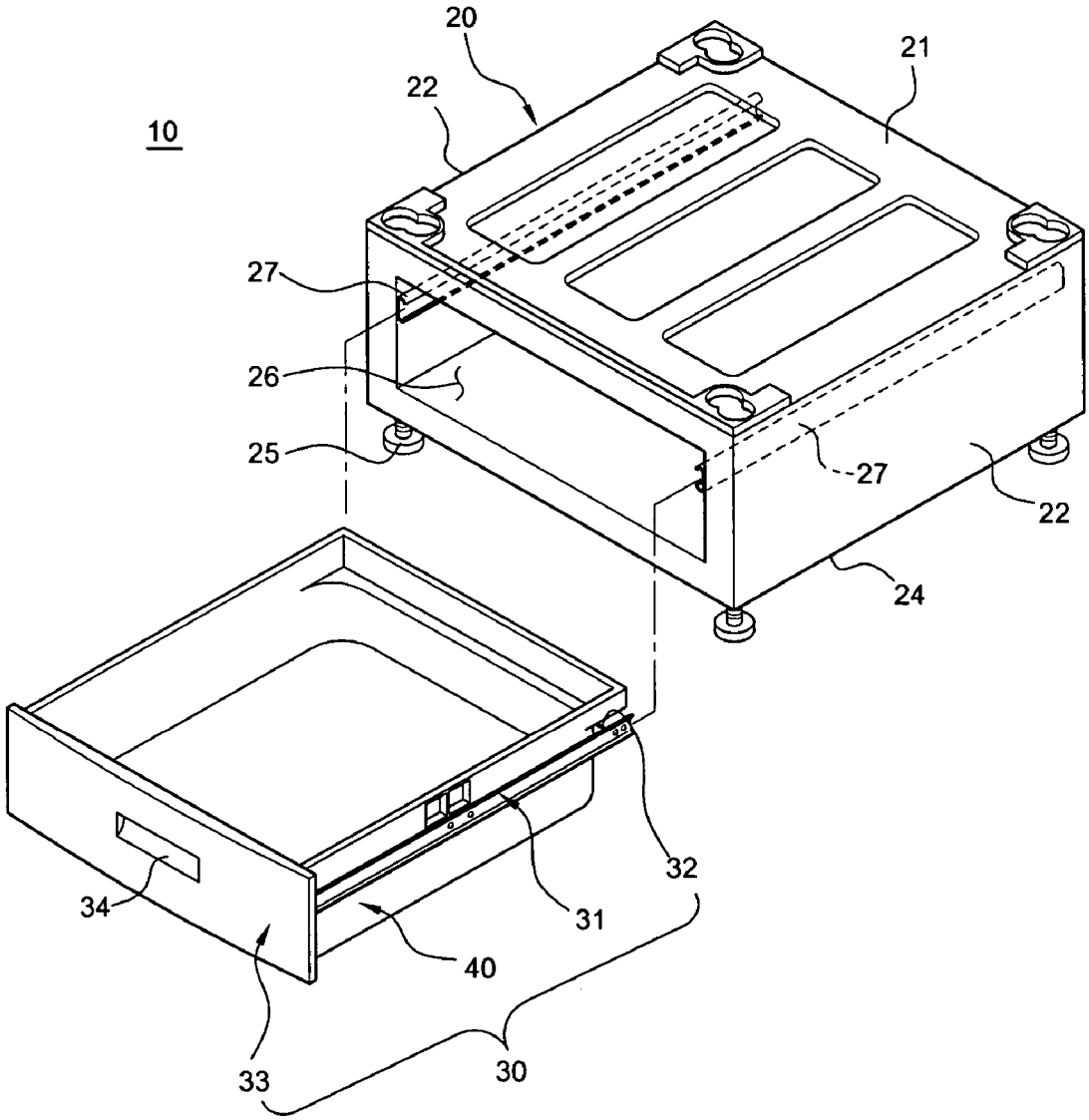
FIG. 2 is a perspective view illustrating a state of separating a drawer from the case of the supporter in FIG. 1.

FIG. 2 is a perspective view illustrating a state of separating a drawer from the case of the supporter in FIG. 1.

As described above, the case 20 includes the upper side 21, the lateral sides 22, the rear side 23, and the bottom side 24 to form a front-side-open box shape having a front-side-open inner space 26 formed therein.

The inner space 26 includes fixed rails 27 along the lateral sides 22 so as to slide the drawer 30 in and out through the inner space 26.

The case 20 is made of a non-metal material for the purpose of being light in weight, a pair of the fixed rails 27 attached with the lateral sides 22 of the case 20 stably support the weight of the drawer 30 and goods accommodated in the drawer 30 and effectively guide the drawer 30 to be slid. The fixed rails 27 are made of a metal material to prevent deformation due to temperature change. Preferably, the drawer 30 is made of synthetic resin by molding, and the fixed rails 27 are made of steel.

The detailed structure of the drawer 30 slid along the fixed rails 27 will be described by referring to FIGS. 3 to 6 as follows.

Figure 3:
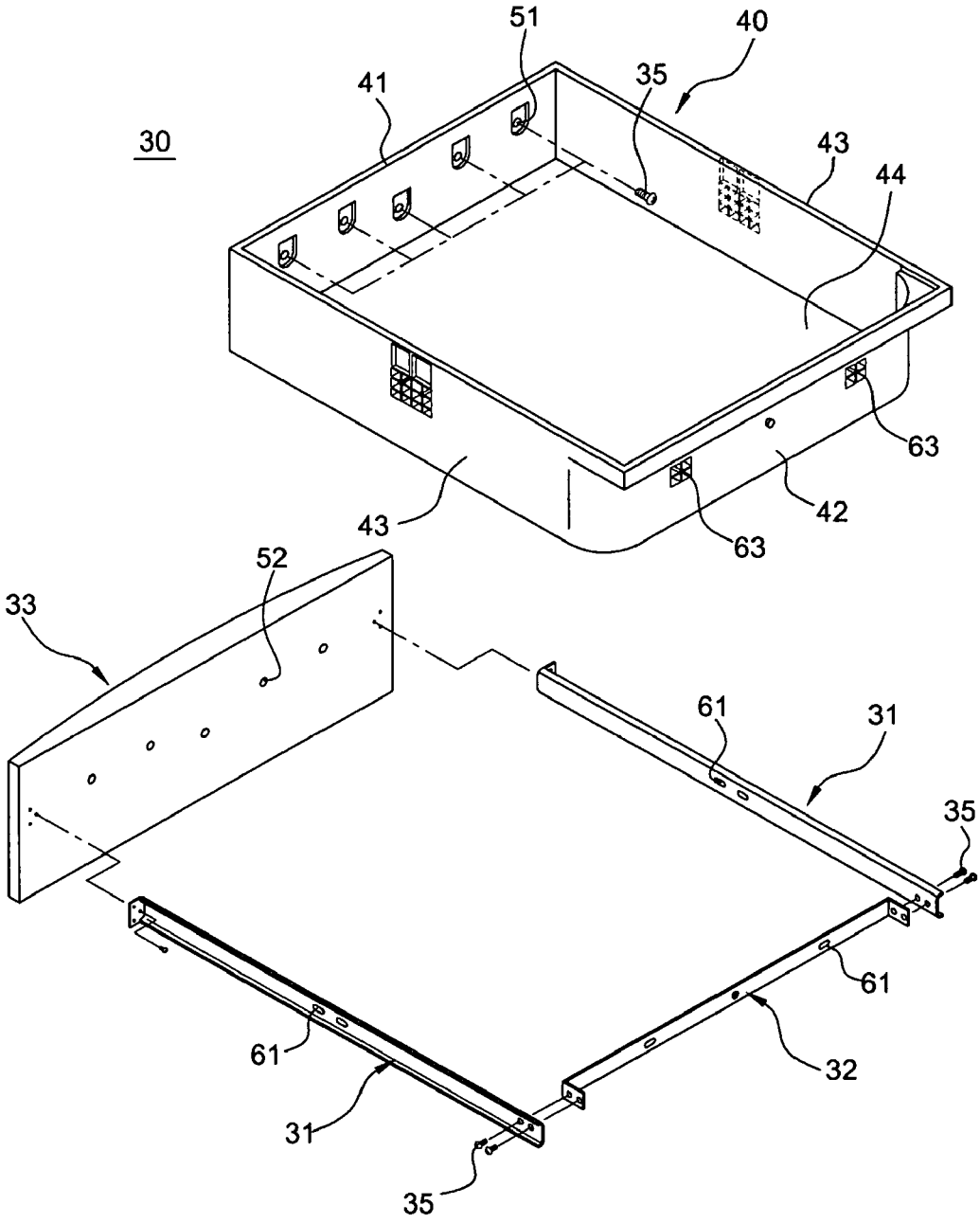
FIG. 3 is a perspective view of the drawer.
Figure 4:
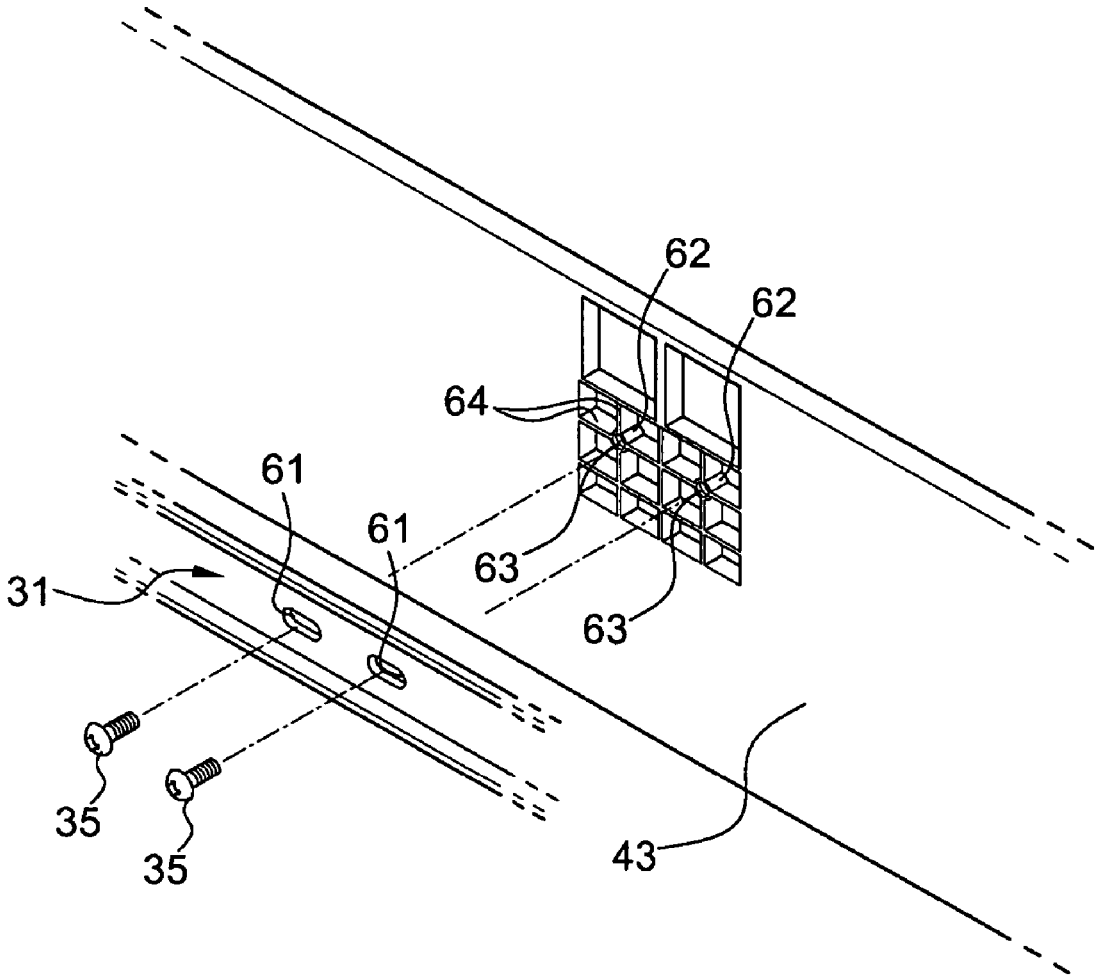
FIG. 4 is a partial perspective view illustrating the structure in which a slide rail is assembled to a main body of the drawer.
Figure 5:
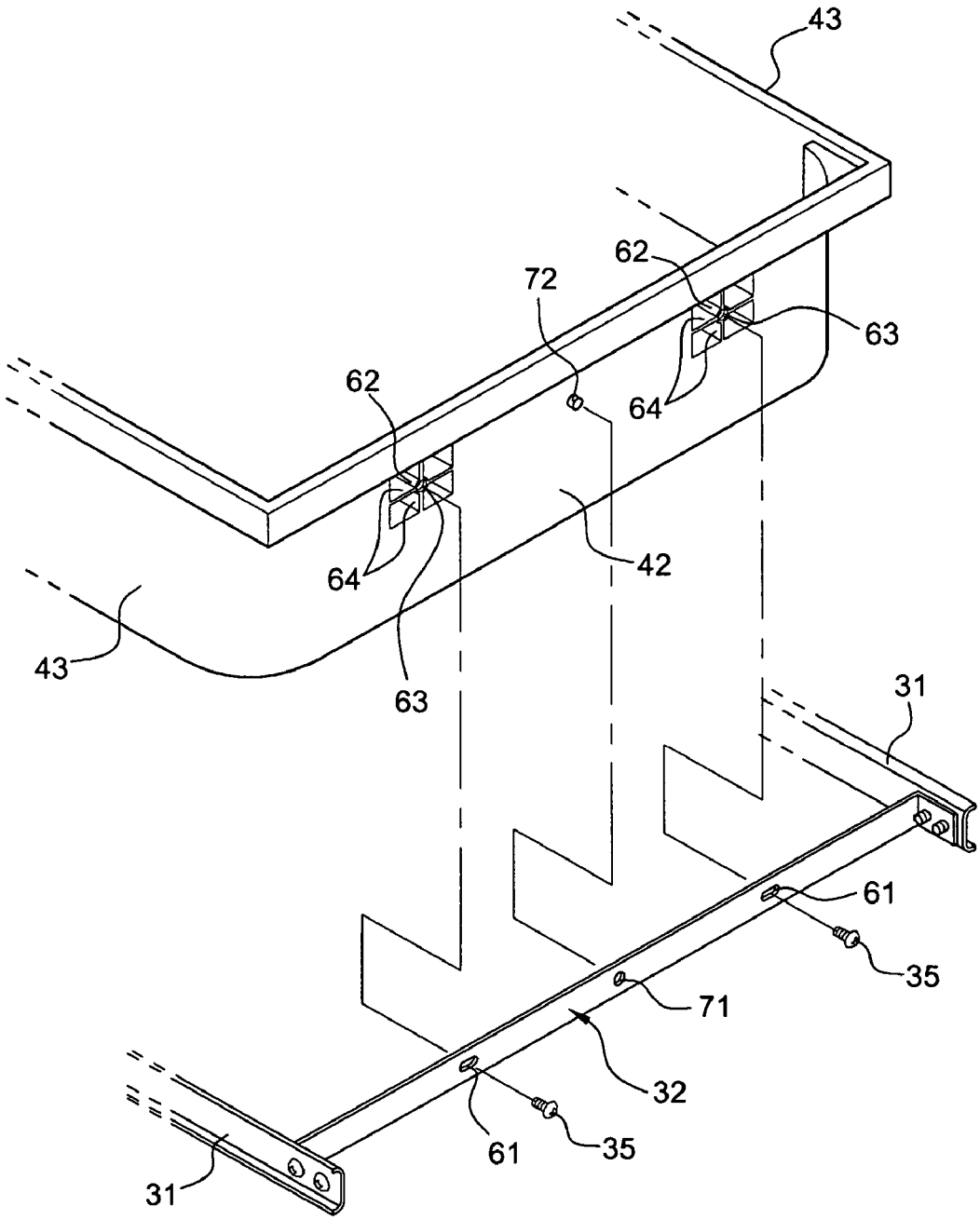
FIG. 5 is a partial perspective view illustrating the structure in which a connecting member is assembled to the main body of the drawer.
Figure 6:
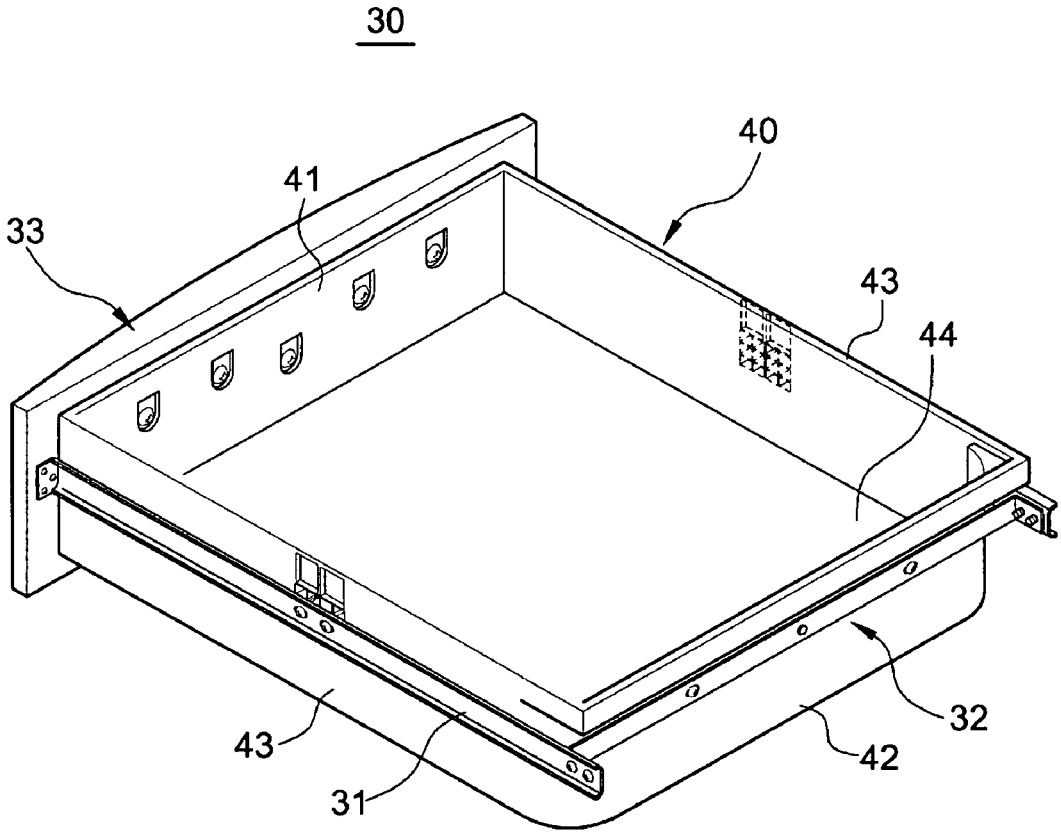
FIG. 6 is a perspective view of an assembled drawer.

FIG. 3 is a perspective view of the drawer, FIG. 4 is a partial perspective view illustrating the structure in which a slide rail is assembled to a main body of the drawer, FIG. 5 is a partial perspective view illustrating the structure in which a connecting member is assembled to the main body of the drawer, and FIG. 6 is a perspective view of the assembled drawer.

In FIG. 3, the drawer 30 includes a main body 40 having a space where goods are accommodated, a pair of slide rails 31 inserted into and slid along the inner space 26, a connecting member 32 to connect the slide rails 31 with each other in order to maintain a position of the slide rails 31 to thereby firmly support the main body 40, and a front panel 33 includes a grip 34 (see FIG. 2) for sliding the drawer forward and rearward.

Each slide rail 31 is fixed with the front panel 33 at a leading edge thereof by screws, and the connecting member 32 is coupled with rear side of the slide rails 31 by screws, and thus, the slide rails 31, the connecting member 32, and the front panel 33 form an approximate quadrangular frame.

The main body 40 includes a front side 41, a rear side 42, lateral sides 43, and a bottom side 44, and having an upper-side-open box shape. The main body 40 is coupled with an inside of the quadrangular frame constructed by the coupling of the slide rails 31, the connecting member 32, and the front panel 33.

The main body 40 and the front panel 33 are made by molding non-metal materials such as synthetic resin, so as to be light in weight in the same manner as with the case 20. The slide rails 31 and the connecting member 32 are made of metal materials such as steel, to firmly support the load of the main body 40 and to prevent deformation caused by temperature change in the same manner as the fixed rails 27.

Therefore, since the main body 40 is coupled with the slide rails 31 and the connecting member 32 to form the quadrangular frame and is inserted into the front panel 33, the main body 40 of the drawer 30 does not undergo deformation caused by weight of the main body 40 and the goods accommodated in the main body 40, and the temperature change. Therefore, each slide rail 31 stably slides along each fixed rail 27 of the case 20. Moreover, due to the firm structure, the drawer 30 can be fully separated from the case 20 and easily installed in the case 20.

The front side 41 of the main body 40 and the front panel 33 made of the synthetic resin include a plurality of screw holes 51 and 52, respectively, and coupled with each other by screws.

In order to fix the main body 40 made of the synthetic resin to with the slide rails 31 and the connecting member 32 made of steel, the slide rails 31 and the connecting member 32 each include a plurality of first screw holes 61, and the lateral sides 43 and the rear side 42 of the main body 40 include a plurality of bosses 62 having a plurality of second screw holes 63 corresponding to the first screw holes 61.

In order for the respective bosses 62 to maintain their rigidity without shape deformation, each boss 62 is provided with ribs 64 extending upward, downward, rightward, and leftward therefrom around each boss 62.

As shown in FIGS. 4 and 5, since the first screw holes 61 of the slide rails 31 and the connecting member 32 are formed long in the longitudinal direction, the first screw holes 61 may be firmly coupled with the respective second screw holes 63 even when sizes of the lateral side 43 and the rear side 42 of the main body 40 made of the synthetic resin are changed due to deformation in the longitudinal direction due to heat deformation or manufacturing tolerance.

Moreover, as shown in FIG. 5, in order for the main body 40 to be easily coupled to the slide rails 31, the main body 40 includes a position determining protrusion 72 protruded outward from a rear central portion of the main body 40, and the connecting member 32 includes a position determining hole 71 at a rear central portion of the connecting member 32, in which the position determining protrusion 72 is inserted therein.

Therefore, as shown in FIG. 6, after the position determining protrusion 72 protruded from the rear side of the main body 40 is inserted into the position determining hole 71 of the connecting member 32 in order to set the assembling position, the connecting member 32 and the slide rails 31 are respectively coupled to the rear side 42 and the lateral sides of the main body 40 by fastening the screws 35 into the first and the second screw holes 61 and 63. Further, by fastening the screws 35 into the screw holes 51 and 52, the front panel 33 is fixed and assembled to the front side 41 of the main body 40.

Moreover, the connecting member 32 and the front panel 33 are coupled with the respective front and rear ends of the slide rails 31 by the screws 35, so that the main body can maintain its shape stably without deformation caused by the slide rails 31, the connecting member 32, and the front panel 33.

As mentioned above, the supporter for the clothes washing machine and the clothes drying apparatus according to the present invention, includes a pair of slide rails connected with each other by the connecting member thus forming the quadrangular frame in association with the front panel, and the main body of the drawer is inserted into and fixed with the frame, thus preventing the drawer from deformation due to temperature change and weight increase. Therefore, the drawer can be stably slid into and out of the case even when the supporter is used for a long time.

Moreover, since the drawer is not deformed by temperature change, the drawer can be fully separated from the case. Therefore, it is convenient to accommodate goods in the drawer and to wash the drawer.

Further, since the holes formed at the slide rails and the connecting member have a longitudinal hole shape, the supporter can be assembled without any difficulty even when the main body of the drawer is deformed and changed in size by heat or the manufacturing tolerance.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A supporter for a clothes washing machine and a clothes drying apparatus, comprising:

a case to support the clothes washing machine or the clothes drying apparatus; and a drawer inserted into the case, the drawer comprising:

a main body having an accommodating space;

a pair of slide rails coupled with lateral sides of the main body; and a connecting member to connect the slide rails with each other and to support the slide rails, the connecting member is coupled with a rear side of the main body in a state that the connecting member is coupled with rear sides of the respective slide rails, wherein the main body comprises a position determining protrusion at a rear side of the main body, and the connecting member which is coupled with the slide rails comprises a position determining hole in which the position determining protrusion is inserted therein.

2. The supporter according to claim 1, wherein the position determining protrusion and the position determining hole are positioned at a rear central portion of the main body and a central portion of the connecting member, respectively.

3. The supporter according to claim 1, wherein the slide rails each comprise first screw holes of a longitudinal shape, respectively.

4. The supporter according to claim 3, wherein the main body further comprises bosses having second screw holes at the lateral sides of the main body, and screws are fastened through the first screw holes and the second screw holes.

5. The supporter according to claim 4, wherein a plurality of ribs are provided around the bosses so as to prevent the bosses from deformation.

6. The supporter according to claim 1, wherein the connecting member comprises a first screw hole of a longitudinal shape.

7. The supporter according to claim 6, wherein the main body further comprises a boss having a second screw hole at the rear side of the main body, and a screw fastened through the first screw hole and the second screw hole.

8. The supporter according to claim 7, wherein a plurality of ribs are provided around the boss so as to prevent the boss from deformation.

* * * * *